US011534898B2

(12) United States Patent
Lin

(10) Patent No.: US 11,534,898 B2
(45) Date of Patent: Dec. 27, 2022

(54) TORQUE WRENCH

(71) Applicant: TORQUE-TECH PRECISION CO., LTD., Taichung (TW)

(72) Inventor: Tien-Lung Lin, Taichung (TW)

(73) Assignee: TORQUE-TECH PRECISION CO., LTD., Taichung (TW)

( * ) Notice: Subject to any disclaimer, the term of this patent is extended or adjusted under 35 U.S.C. 154(b) by 166 days.

(21) Appl. No.: 17/158,021

(22) Filed: Jan. 26, 2021

(65) Prior Publication Data

US 2022/0184783 A1 Jun. 16, 2022

(30) Foreign Application Priority Data

Dec. 15, 2020 (TW) ..... 109144234

(51) Int. Cl.
*B25B 23/142* (2006.01)
*B25B 23/16* (2006.01)
*B25B 23/00* (2006.01)

(52) U.S. Cl.
CPC ..... *B25B 23/1427* (2013.01); *B25B 23/0028* (2013.01); *B25B 23/16* (2013.01)

(58) Field of Classification Search
CPC ..... B25B 23/1427; B25B 23/141; B25B 23/1422; B25B 23/16
USPC ..... 81/481
See application file for complete search history.

(56) References Cited

U.S. PATENT DOCUMENTS 3,608,403 A * 9/1971 Green ..... B25B 23/1427 81/477

* cited by examiner

*Primary Examiner* — Joseph J Hail
*Assistant Examiner* — Robert C Moore
(74) *Attorney, Agent, or Firm* — Pai Patent & Trademark Law Firm; Chao-Chang David Pai

(57) ABSTRACT

A torque wrench has a hollow tubular body. A long rod and a short rod are provided in the hollow tubular body. The hollow tubular body is formed with a first through hole and a second through hole respectively corresponding to the long rod and the short rod. A first limiting unit is provided in the first through hole, and a second limiting unit is provided in the second through hole. The first limiting unit enables to slide into a first gap spaced apart between the long rod and the hollow tubular body to limit the swing range of the long rod, and the second limiting unit enables to slide into a second gap spaced apart between the short rod and the hollow tubular body to limit the swing range of the short rod, thereby improving the accuracy of the tripping torque and making the torque wrench easy to calibrate.

10 Claims, 7 Drawing Sheets

TORQUE WRENCH

FIELD OF THE INVENTION

The present invention relates to a torque wrench.

BACKGROUND OF THE INVENTION

A conventional torque wrench has a hollow tubular body. One end of the hollow tubular body is connected to a drive head, and the other end of the hollow tubular body is connected to a grip. A trip mechanism is provided in the hollow tubular body. The trip mechanism has a long rod and a short rod. A trip member is connected between the long rod and the short rod and configured to trip when the trip mechanism reaches a predetermined torque value. The trip mechanism is further connected with an adjustment unit configured to adjust the predetermined torque value. However, in the conventional torque wrench, a gap is spaced apart between the long rod and an inner wall surface of the tube body and between the short rod and an inner wall surface of the tube body, which is characterized as the swing space of the long rod and the short rod when they are subject to the torque. However, when the user uses the torque wrench and makes the trip mechanism to trip, the deflection amplitude of the long rod and the short rod in the gap is too large, the tripping torque of the torque wrench will be fluctuated excessively during operation, resulting in reduced accuracy and difficulty in calibrating the torque value. Accordingly, the inventor of the present invention has devoted himself based on his many years of practical experiences to solve these problems.

SUMMARY OF THE INVENTION

The primary object of the present invention is to provide a torque wrench, which can automatically adjust the swing range of a long rod and a short rod, thereby improving the accuracy of the tripping torque and making the torque wrench easy to calibrate.

In order to achieve the above object, the torque wrench provided by the present invention comprises a hollow tubular body. One end of the hollow tubular body is connected to a drive head, and another end of the hollow tubular body is connected to a grip. A trip mechanism is provided in the hollow tubular body. The trip mechanism has a long rod and a short rod arranged side by side. A trip member is connected between the long rod and the short rod and configured to trip when the trip mechanism reaches a predetermined torque value. The trip mechanism is further connected with an adjustment unit configured to adjust the predetermined torque value. A first gap is spaced apart between an inner wall surface of the hollow tubular body and one side of the long rod. An outer wall surface of the hollow tubular body is formed with a first through hole communicating with the first gap. A first limiting unit is accommodated in the first through hole. The first limiting unit has a first sliding member. The first sliding member is slidable in the first through hole. One side of the first sliding member has a first limiting portion extending toward the first gap. Another side of the first sliding member is provided with a first pushed portion. The first pushed portion is connected with a first pushing member. The first pushing member is configured to apply a force to the first pushed portion toward the first gap to make the first sliding member having a movement tendency toward the first gap. A second gap is spaced apart between the inner wall surface of the hollow tubular body and one side of the short rod. The outer wall surface of the hollow tubular body is formed with a second through hole communicating with the second gap. A second limiting unit is accommodated in the second through hole. The second limiting unit has a second sliding member. The second sliding member is slidable in the second through hole. One side of the second sliding member has a second limiting portion extending toward the second gap. Another side of the second sliding member is provided with a second pushed portion. The second pushed portion is connected with a second pushing member. The second pushing member is configured to apply a force to the second pushed portion toward the second gap to make the second sliding member having a movement tendency toward the second gap.

The torque wrench provided in the present invention, the first limiting portion is pushed by the first pushing member and has a movement tendency toward the direction of the first gap, and the second limiting portion is pushed by the second pushing member and has a movement tendency toward the direction of the second gap. When the torque wrench starts calibration and proceeds to preloading process, as long as the height of the first gap is greater than the height of the first limiting portion, the first limiting portion of the first sliding member enables to slide into the first gap to restrict the swing range of the long rod. Thereby, when the torque wrench is in the preloading stage, the first limiting unit and the second limiting unit enables to automatically restrict the swing range of the long rod and the short rod, so as to improve the accuracy of the tripping torque and to calibrate the torque wrench with ease.

DETAILED DESCRIPTION OF THE PREFERRED EMBODIMENTS

Embodiments of the present invention will now be described, by way of example only, with reference to the accompanying drawings.

Figure 1:
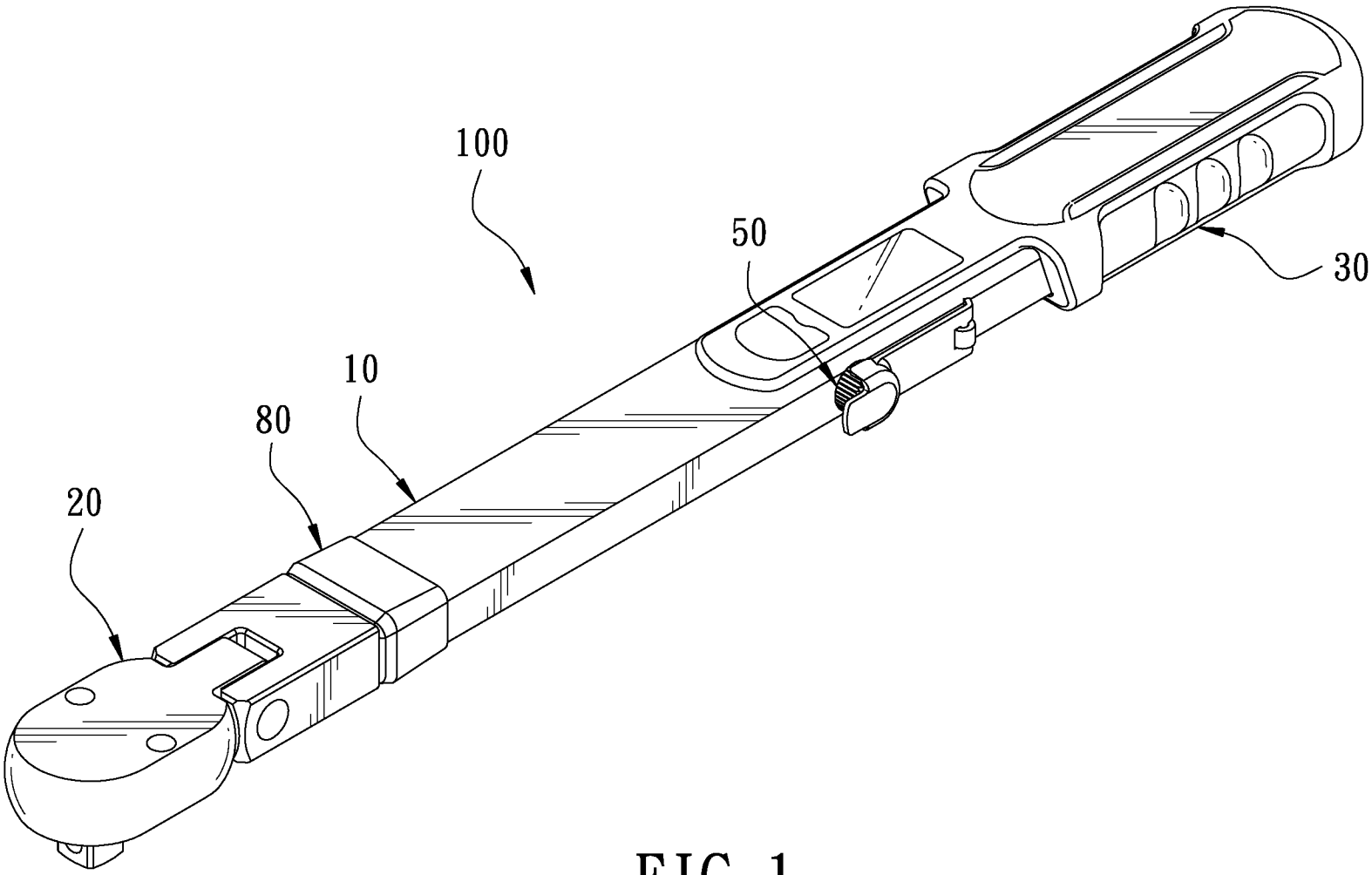
FIG. 1 is a perspective view in accordance with a preferred embodiment of the present invention.
Figure 2:
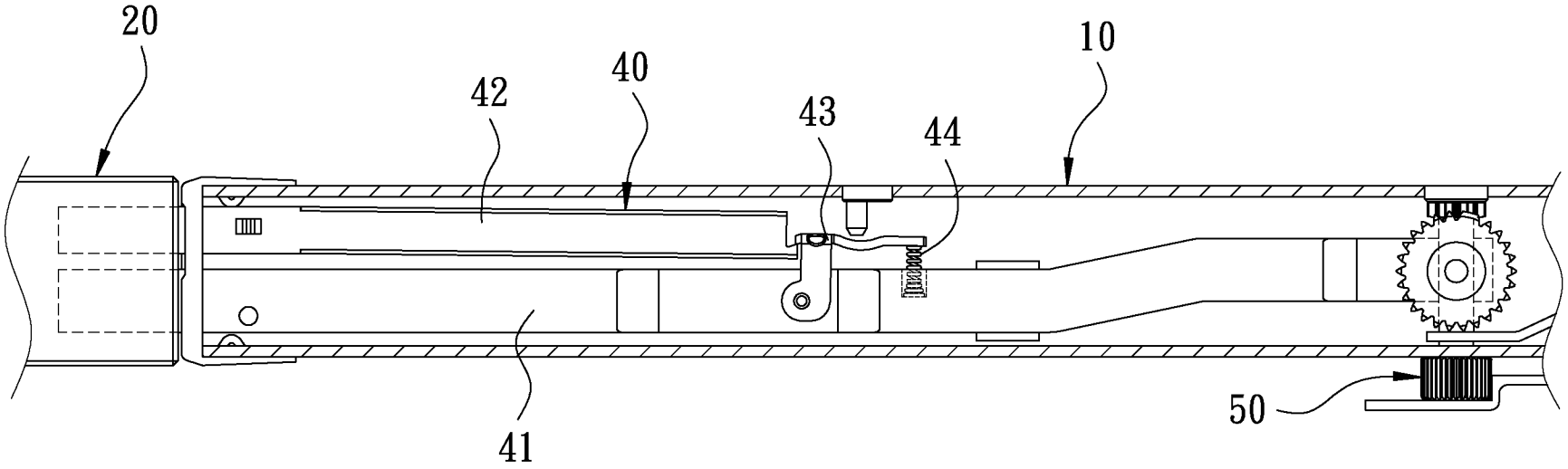
FIG. 2 is a cross-sectional view in accordance with the preferred embodiment of the present invention.

FIG. 1 is a perspective view in accordance with a preferred embodiment of the present invention. FIG. 2 is a cross-sectional view in accordance with the preferred embodiment of the present invention. The present invention discloses a torque wrench 100. The torque wrench 100 includes a hollow tubular body 10. One end of the hollow tubular body 10 is connected to a drive head 20, and the other end of the hollow tubular body 10 is connected to a grip 30. A trip mechanism 40 is provided in the hollow tubular body 10. The trip mechanism 40 has a long rod 41 and a short rod 42 arranged side by side. One end of the long rod 41 is connected to the drive head 20, and the other end of the long rod 41 extends toward the grip 30 and is connected to a torque adjustment mechanism 50 that is configured to adjust a predetermined torque value. One end of the short rod 42 is connected to the drive head 20, and the other end of the short rod 42 extends toward the grip 30 and is defined as a free end. The long rod 41 is provided with a rotatable trip member 43. The trip member 43 is connected with an elastic member 44. The elastic member 44 elastically pushes against the trip member 43 and presses against the free end of the short rod 42, which is configured to trip when the trip mechanism 40 reaches the predetermined torque value to produce a mechanical sound and vibration for prompting the user to stop the operation.

Figure 3:
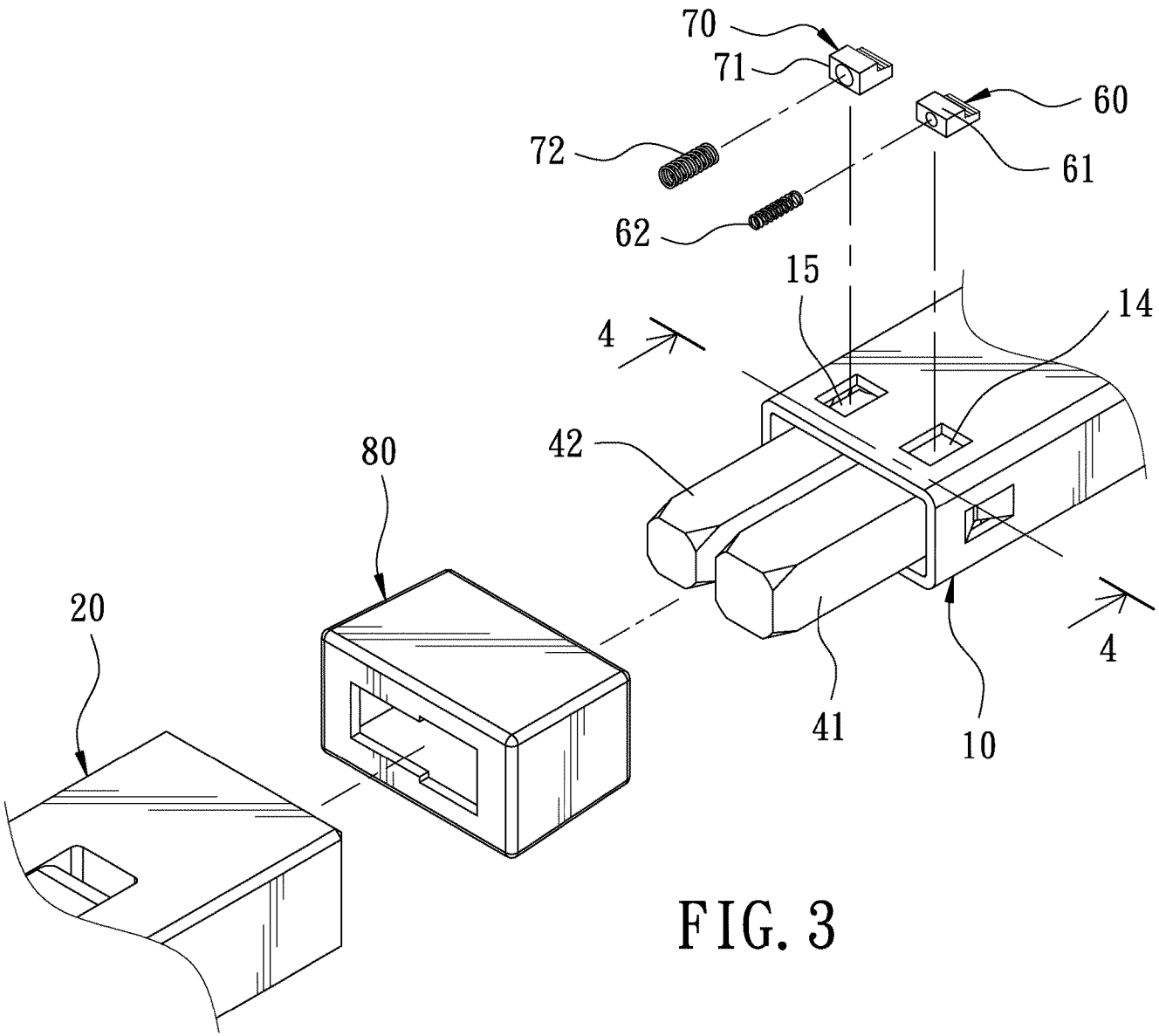
FIG. 3 is a partial exploded view in accordance with the preferred embodiment of the present invention.
Figure 4:
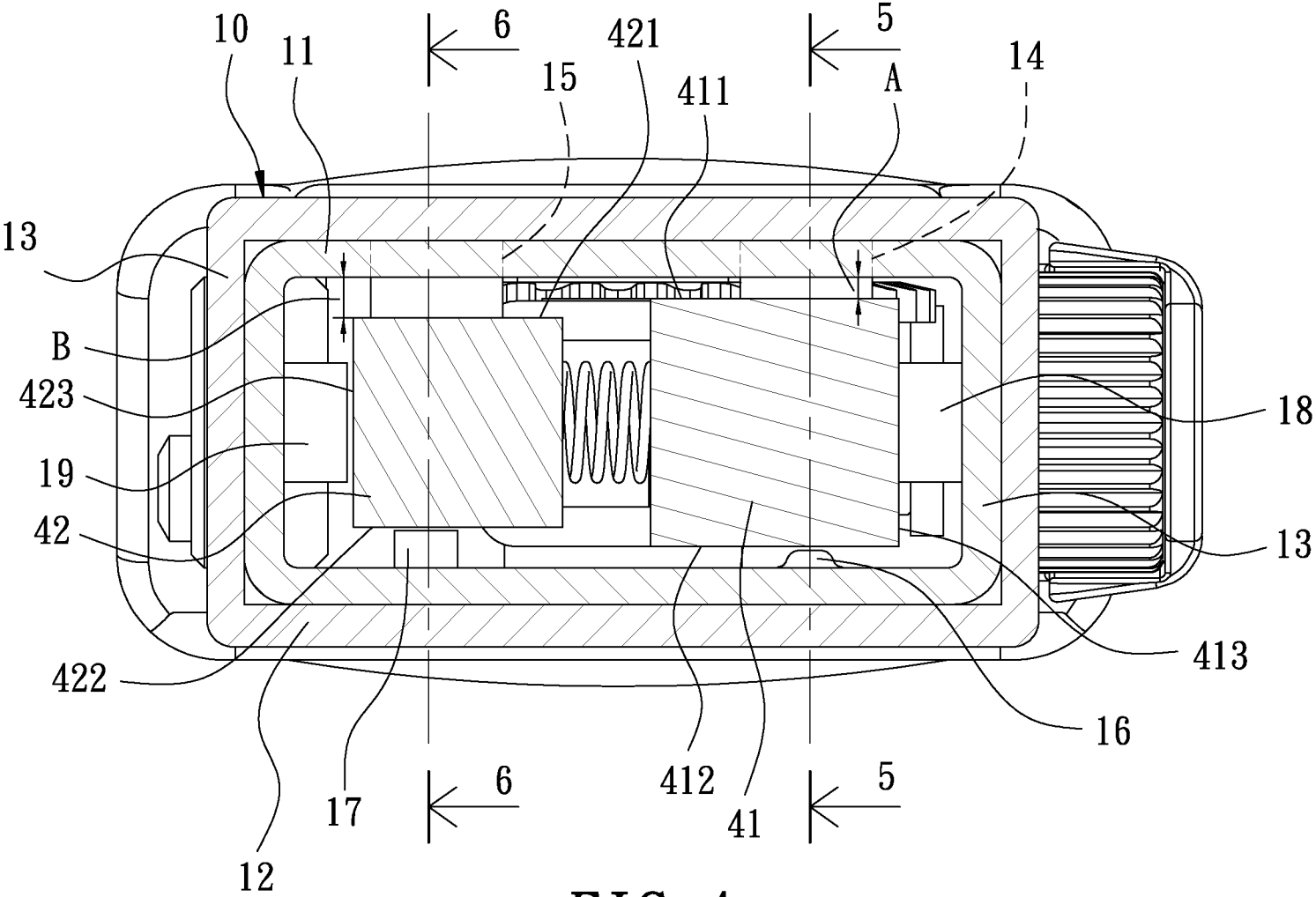
FIG. 4 is a cross-sectional view taken along line 4-4 of FIG. 3 in accordance with the preferred embodiment of the present invention.

FIG. 3 is a partial exploded view in accordance with the preferred embodiment of the present invention. FIG. 4 is a cross-sectional view taken along line 4-4 of FIG. 3 in accordance with the preferred embodiment of the present invention. The hollow tubular body 10 is a square tube, and has a top wall 11, a bottom wall 12 opposite to the top wall 11 and two side walls 13 connected between the top wall 11 and the bottom wall 12. The long rod 41 is a square rod, and has a first top surface 411 corresponding to the top wall 11, a first bottom surface 412 corresponding to the bottom wall 12 and two first side surfaces 413 corresponding to the side walls 13. The short rod 42 is a square rod, and has a second top surface 421 corresponding to the top wall 11, a second bottom surface 422 corresponding to the bottom wall 12 and two second side surfaces 423 corresponding to the side walls 13. A first gap A is spaced apart between an inner wall surface of the top wall 1 land the first top surface 411 of the long rod 41. An outer wall surface of the top wall 11 corresponding in position to the long rod 41 is provided with a first through hole 14 communicating with the first gap A. A first limiting unit 60 is provided in the first through hole 14. A second gap B is spaced apart between the inner wall surface of the top wall 11 and the second top surface 421 of the short rod 42. The outer wall surface of the top wall 11 corresponding in position to the short rod 42 is formed with a second through hole 15 communicating with the second gap B. A second limiting unit 70 is provided in the second through hole 15. In addition, the hollow tubular body 10 has a first protrusion 16 extending from the bottom wall 12 and facing toward the first bottom surface 412 and a second protrusion 17 extending from the bottom wall 12 and facing toward the second bottom surface 422. The side wall 13 of the hollow tubular body 10 adjacent to the long rod 41 has a third protrusion 18 extending toward the first side surface 413, and the side wall 13 adjacent to the short rod 42 has a fourth protrusion 19 extending toward the second side surface 423. Thereby, the long rod 41 only possesses the degree of freedom moving toward the direction of the first gap A, and the short rod 42 only possesses the degree of freedom moving toward the direction of the second gap B. The torque wrench 100 further includes a protection cover 80. The protection cover 80 is sleeved onto the hollow tubular body 10 and located on outer sides of the first through hole 14 and the second through hole 15 provided for confining the first limiting unit 60 in the first through hole 14 and the second limiting unit 70 in the second through hole 15.

Figure 5:
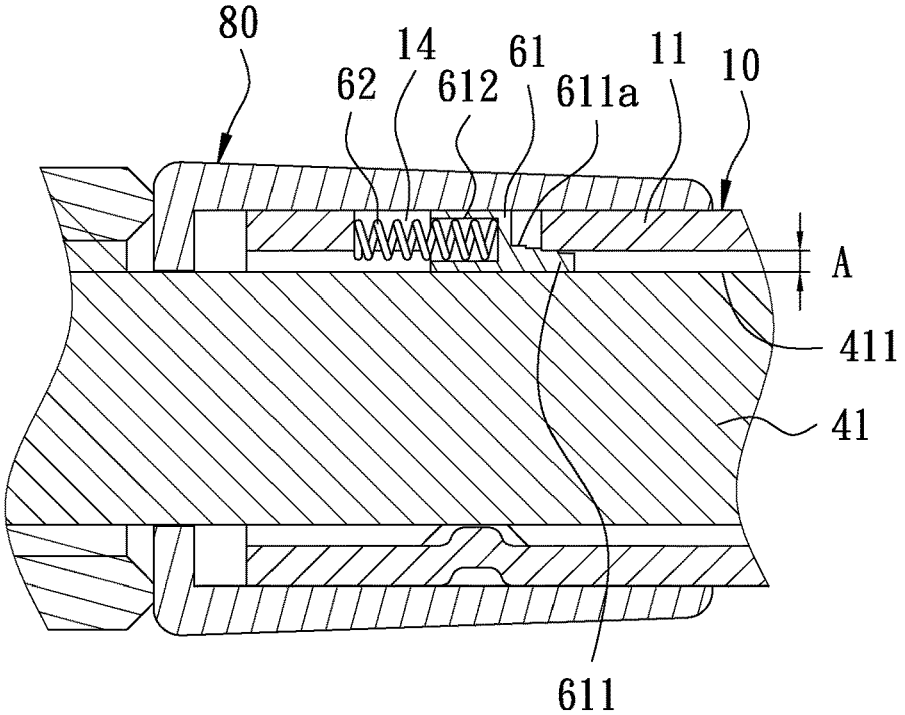
FIG. 5 is a cross-sectional view taken along line 5-5 of FIG. 4 in accordance with the preferred embodiment of the present invention.

Please refer to FIG. 3 and FIG. 5 that is a cross-sectional view taken along line 5-5 of FIG. 4 in accordance with the preferred embodiment of the present invention. The first through hole 14 is a rectangular hole. The first limiting unit 60 has a first sliding member 61 able to slide in the first through hole 14. One side of the first sliding member 61 has a first limiting portion 611 facing toward the first gap A and extending in the longitudinal direction of the first through hole 14. In this embodiment, the first limiting portion 611 is gradually tapered in the direction of movement toward the first gap A. Preferably, the first limiting portion 611 is formed in a stepped shape and has a plurality of first steps 611*a* with gradually decreasing heights. The other side of the first sliding member 61 is provided with a first pushed portion 612, such as a blind hole shown in this embodiment. The first pushed portion 612 is connected with a first pushing member 62, such as a spring shown in this embodiment. Two ends of the spring abut against the first pushed portion 612 and an inner wall surface of the first through hole 14 respectively for the purpose of pushing the first sliding member 61 to slide along the longitudinal direction of the first through hole 14, so that the first limiting portion 611 possesses a movement tendency toward the direction of the first gap A. A diameter of the first pushing member 62 is not less than 1.2 times the first gap A, which prevents the first pushing member 62 from separating from the first through hole 14.

Figure 6:
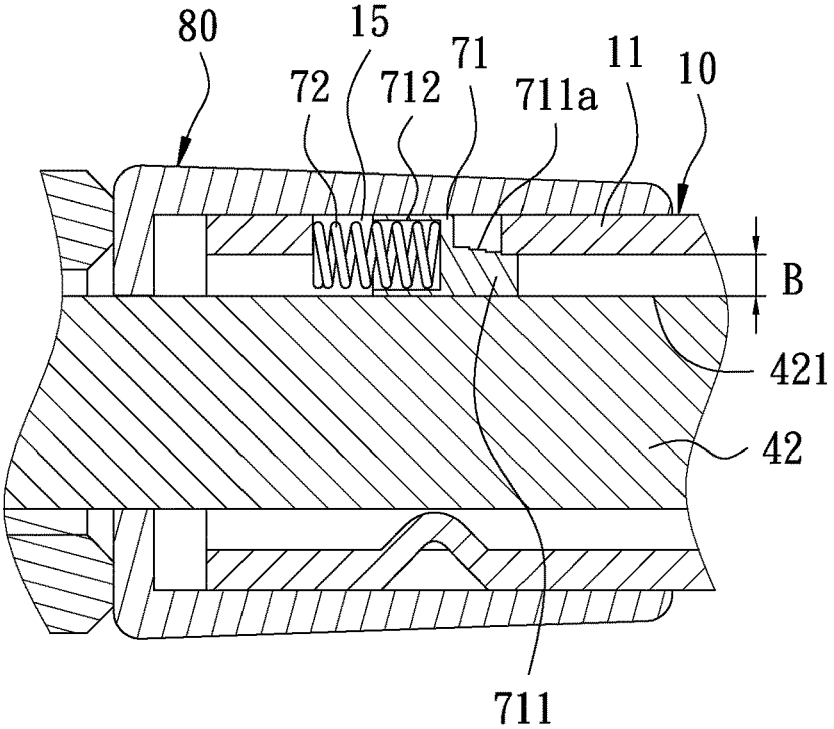
FIG. 6 is a cross-sectional view taken along line 6-6 of FIG. 4 in accordance with the preferred embodiment of the present invention.

Please refer to FIG. 3 and FIG. 6 that is a cross-sectional view taken along line 6-6 of FIG. 4 in accordance with the preferred embodiment of the present invention. The second through hole 15 is a rectangular hole. The second limiting unit 70 has a second sliding member 71 able to slide in the second through hole 15. One side of the second sliding member 71 has a second limiting portion 711 facing toward the second gap B and extending in the longitudinal direction of the second through hole 15. In this embodiment, the second limiting portion 711 is gradually tapered in the direction of movement toward the second gap B. Preferably, the second limiting portion 711 is formed in a stepped shape and has a plurality of second steps 711*a* with gradually decreasing heights. The other side of the second sliding member 71 is provided with a second pushed portion 712, such as a blind hole shown in this embodiment. The second pushed portion 712 is connected with a second pushing member 72, such as a spring shown in this embodiment. Two ends of the spring abut against the second pushed portion 712 and an inner wall surface of the second through hole 15 respectively for the purpose of pushing the second sliding member 71 to slide along the longitudinal direction of the second through hole 15, so that the second limiting portion 711 possesses a movement tendency toward the direction of the second gap B. A diameter of the second pushing member 72 is not less than 1.2 times the second gap B, which prevents the second pushing member 72 from separating from the second through hole 15.

Figure 7:
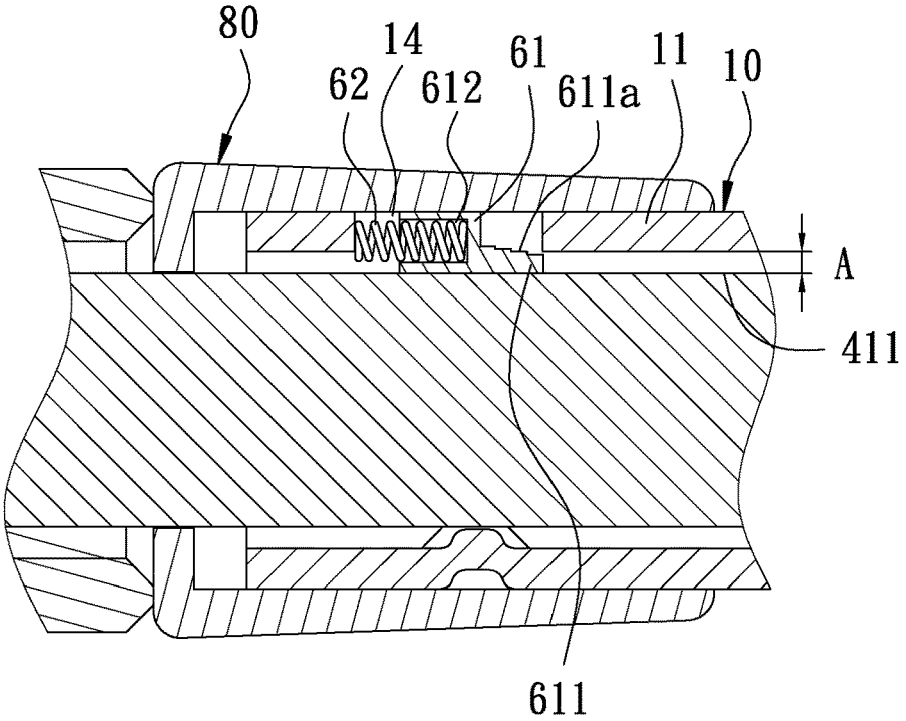
FIG. 7 is a schematic view of the operation of the preferred embodiment of the present invention, showing the state before the first limiting unit slides into the first gap.
Figure 8:
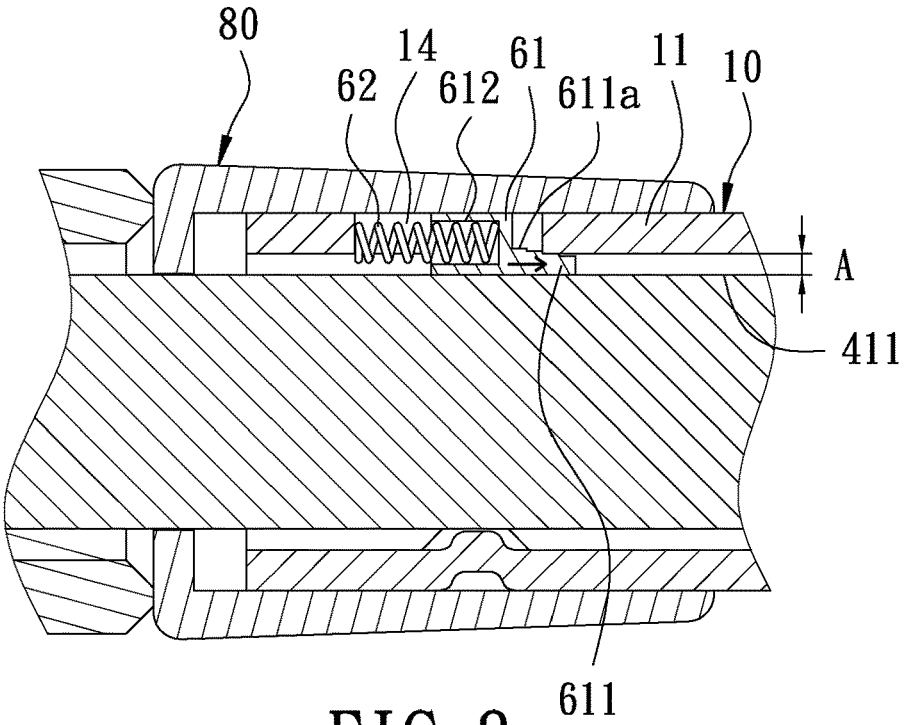
FIG. 8 is a schematic view of the operation of the preferred embodiment of the present invention, showing the state after the first limiting unit slides into the first gap.

FIG. 7 and FIG. 8 are schematic views showing the operation of the preferred embodiment of the present invention. The long rod 41 is inserted into the hollow tubular body 10. Then, one end of the first pushing member 62 leans against the first pushed portion 612 of the first sliding member 61 and is inserted into the first through hole 14, and the other end of the first pushing member 62 leans against the inner wall surface of the first through hole 14, thereby completing the assembly of the long rod 41. Because the first gap A exists between the top wall 11 and the first top surface 411, the user can easily insert the long rod 41 into the hollow tubular body 10. Finally, as shown in FIG. 8, when the torque wrench 100 starts calibration and proceeds to preloading process, the long rod 41 swings due to torque releasement. At this moment, owing to the reason that the first limiting portion 611 is pushed by the first pushing member 62 and possesses a movement tendency toward the direction of the first gap A, as long as the height of the first gap A is greater than the height of the first limiting portion 611, the first limiting portion 611 enables to slide into the first gap A, and the first limiting portion 611 is confined in the first gap A to restrict the swing range of the long rod 41. Preferably, the swing range of the long rod 41 is restricted to less than 0.1 mm through the first limiting portion 611. Thereby, the swing range of the long rod 41 enables to be controlled within a range that can be easily calibrated through the first limiting unit 60. It is worth noting that because the first limiting portion 611 is formed in a stepped shape and has a plurality of first steps 611*a* whose height gradually decreases in the direction toward the first gap A, according to the size of the first gap A, the first limiting portion 611 allows the one of the first steps 611*a* with corresponding height to slide into the first gap A, so that the effect of multi-sectional adjustment can be achieved to accurately control the swing range of the long rod 41 within the range that can be easily calibrated. On the other hand, the stepped design also prevents the reaction force of the long rod 41 from pushing the first sliding member 61 out of the first gap A. In the present invention, the first gap A between the first top surface 411 of the long rod 41 and the top wall 11 of the hollow tubular body 10 for each individual torque wrench slightly varies due to dimensional tolerance and assembly tolerance. Therefore, when each torque wrench is preloaded, a displacement of the first limiting portion 611 inserted into the first gap A enables to be adjusted by the pushing tendency of the first pushing member 62, thus effectively restraining the longitudinal deflection of the long rod 41 as the torsion force trips.

Figure 9:
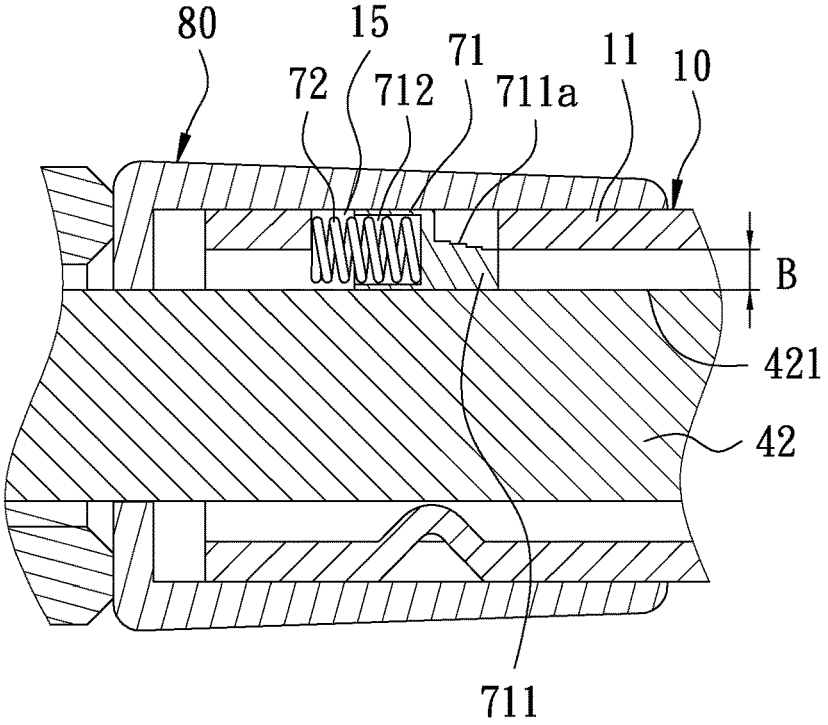
FIG. 9 is a schematic view of the operation of the preferred embodiment of the present invention, showing the state before the second limiting unit slides into the first gap.
Figure 10:
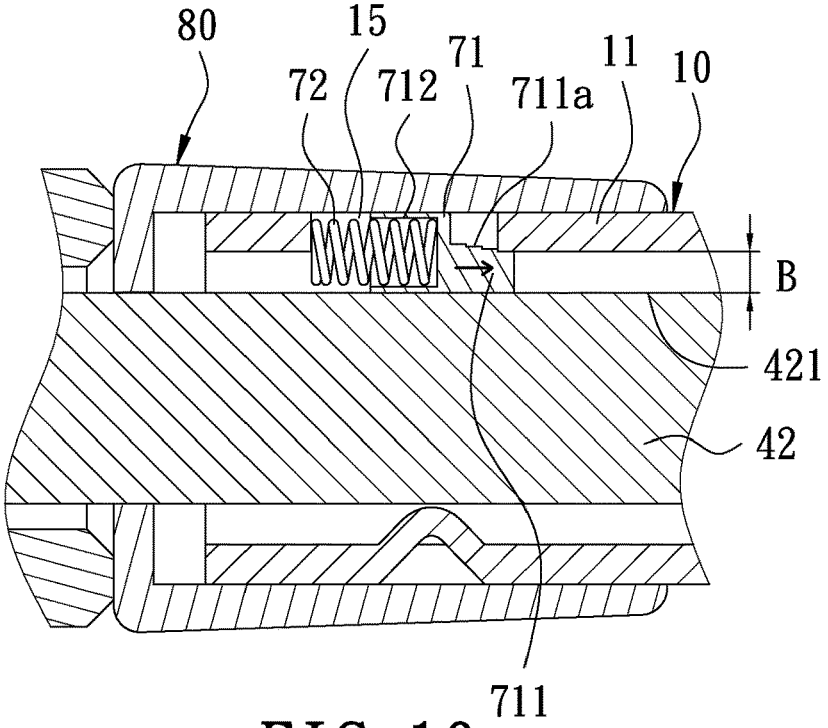
FIG. 10 is a schematic view of the operation of the preferred embodiment of the present invention, showing the state after the second limiting unit slides into the first gap.

FIG. 9 and FIG. 10 are schematic views showing the operation of the preferred embodiment of the present invention, applying the same principle. The short rod 42 is inserted into the hollow tubular body 10. Then, the second limiting unit 70 is placed in the second through hole 15. When the torque wrench 100 starts calibration and proceeds to preloading process, the short rod 42 swings due to torque releasement. At this moment, owing to the reason that the second limiting portion 711 is pushed by the second pushing member 72 and possesses a movement tendency toward the direction of the second gap B, as long as the height of the second gap B is greater than the height of the second limiting portion 711, the second limiting portion 711 enables to slide into the second gap B, and the second limiting portion 711 is confined in the second gap B to restrict the swing range of the short rod 42. In addition, because the second limiting portion 711 is formed in a stepped shape and has a plurality of second steps 711*a* whose height gradually decreases in the direction toward the second gap B, according to the size of the second gap B, the second limiting portion 711 allows the one of the second steps 711*a* with corresponding height to slide into the second gap B, so that the effect of multi-sectional adjustment can be achieved to accurately control the swing range of the short rod 42 within the range that can be easily calibrated. In the present invention, the second gap B between the second top surface 421 of the short rod 42 and the top wall 11 of the hollow tubular body 10 for each individual torque wrench slightly varies due to dimensional tolerance and assembly tolerance. Therefore, when each torque wrench is preloaded, a displacement of the second limiting portion 711 inserted into the second gap B enables to be adjusted by the pushing tendency of the second pushing member 72, thus effectively restraining the longitudinal deflection of the short rod 42 as the torsion force trips.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A torque wrench, comprising a hollow tubular body, one end of the hollow tubular body being connected to a drive head, the other end of the hollow tubular body being connected to a grip, a trip mechanism being provided in the hollow tubular body, the trip mechanism having a long rod and a short rod arranged side by side, a trip member being connected between the long rod and the short rod, the trip member being configured to trip when the trip mechanism reaches a predetermined torque value, the trip mechanism being further connected with an adjustment unit configured to adjust the predetermined torque value;

a first gap being spaced apart between an inner wall surface of the hollow tubular body and one side of the long rod, a second gap being spaced apart between the inner wall surface of the hollow tubular body and one side of the short rod, an outer wall surface of the hollow tubular body being formed with a first through hole communicating with the first gap and a second through hole communicating with the second gap;

a first limiting unit, accommodated in the first through hole and having a first sliding member, the first sliding member being slidable in the first through hole, one side of the first sliding member having a first limiting portion extending toward the first gap, another side of the first sliding member being provided with a first pushed portion, the first pushed portion being connected with a first pushing member, the first pushing member being configured to apply a force to the first pushed portion toward the first gap to make the first sliding member having a movement tendency toward the first gap and to make the first limiting portion restricted in the first gap;

a second limiting unit, accommodated in the second through hole and having a second sliding member, the second sliding member being slidable in the second through hole, one side of the second sliding member having a second limiting portion extending toward the second gap, another side of the second sliding member being provided with a second pushed portion, the second pushed portion being connected with a second pushing member, the second pushing member being configured to apply a force to the second pushed portion toward the second gap to make the second sliding member having a movement tendency toward the second gap and make the second limiting portion restricted in the second gap.

2. The torque wrench as claimed in claim 1, wherein the hollow tubular body is a square tube, the hollow tubular body has a top wall, a bottom wall opposite to the top wall and two side walls connected between the top wall and the bottom wall, the long rod is a square rod, the long rod has a first top surface corresponding to the top wall, a first bottom surface corresponding to the bottom wall and two first side surfaces corresponding to the side walls, the first gap is spaced apart between the top wall and the first top surface, and the top wall of the hollow tubular body, corresponding in position to the long rod, is formed with the first through hole.

3. The torque wrench as claimed in claim 2, wherein the first through hole is a rectangular hole, one side of the first sliding member has the first limiting portion extending in a longitudinal direction of the first through hole, the first pushing member is a spring, two ends of the spring respectively abut against the first pushed portion and an inner wall surface of the first through hole provided for pushing the first sliding member to slide along the longitudinal direction of the first through hole, so that the first limiting portion has the movement tendency to move toward the first gap and is restricted in the first gap.

4. The torque wrench as claimed in claim 1, wherein the hollow tubular body is a square tube, the hollow tubular body has a top wall, a bottom wall opposite to the top wall and two side walls connected between the top wall and the bottom wall, the short rod is a square rod, the short rod has a second top surface corresponding to the top wall, a second bottom surface corresponding to the bottom wall and two second side surfaces corresponding to the side walls, the second gap is spaced apart between the top wall and the second top surface, and the top wall of the hollow tubular body, corresponding in position to the short rod, is formed with the second through hole.

5. The torque wrench as claimed in claim 4, wherein the second through hole is a rectangular hole, one side of the second sliding member has the second limiting portion extending in a longitudinal direction of the second through hole, the second pushing member is a spring, two ends of the spring respectively abut against the second pushed portion and an inner wall surface of the second through hole provided for pushing the second sliding member to slide along the longitudinal direction of the second through hole, so that the second limiting portion has the movement tendency to move toward the second gap and is restricted in the second gap.

6. The torque wrench as claimed in claim 1, wherein when the torque wrench is preloaded, a displacement of the first limiting portion inserted into the first gap enables to be selectively adjusted by pushing tendency of the first pushing member, and a displacement of the second limiting portion inserted into the second gap enables to be selectively adjusted by a pushing tendency of the second pushing member.

7. The torque wrench as claimed in claim 6, wherein the first limiting portion is gradually tapered in the direction of movement toward the first gap, and the second limiting portion is gradually tapered in the direction of movement toward the second gap.

8. The torque wrench as claimed in claim 7, wherein the first limiting portion is formed in a stepped shape and has a plurality of first steps with gradually decreasing heights, and the second limiting portion is formed in a stepped shape and has a plurality of second steps with gradually decreasing heights.

9. The torque wrench as claimed in claim 1, wherein the first pushing member is a spring having a diameter not less than 1.2 times the first gap, and the second pushing member is a spring having a diameter not less than 1.2 times the second gap.

10. The torque wrench as claimed in claim 1, further comprising a protection cover, the protection cover being sleeved onto the hollow tubular body and located on outer sides of the first through hole and the second through hole for confining the first limiting unit in the first through hole and the second limiting unit in the second through hole.

* * * * *